United States Patent [19]

Schrewe

[11] 4,194,555

[45] Mar. 25, 1980

[54] TUNDISH FOR CONTINUOUS CASTING

[75] Inventor: Hans Schrewe, Duisburg, Fed. Rep. of Germany

[73] Assignee: Mannesmann Aktiengesellschaft, Dusseldorf, Fed. Rep. of Germany

[21] Appl. No.: 940,167

[22] Filed: Sep. 7, 1978

[30] Foreign Application Priority Data

Sep. 8, 1977 [DE] Fed. Rep. of Germany ..... 2740725

[51] Int. Cl.[2] ..... B22D 11/10

[52] U.S. Cl. ..... 164/438; 222/606

[58] Field of Search ..... 164/133, 136, 337, 335, 164/437, 438, 82, 4, 154, 155, 449; 222/606, 607; 266/165

[56] References Cited

U.S. PATENT DOCUMENTS 4,090,552 5/1978 Laird et al. ..... 164/438

*Primary Examiner*—Robert D. Baldwin
*Assistant Examiner*—K. Y. Lin
*Attorney, Agent, or Firm*—Smyth, Pavitt, Siegemund, Jones & Martella

[57] ABSTRACT

The tundish is mounted on a frame which can be lifted in relation to a carriage. A holder for a casting pipe is either positioned on the frame to be lifted therewith or on the carriage to be controlled in synchronism with the frame lifting so that the pipe retains its position relative to the tundish.

3 Claims, 2 Drawing Figures

TUNDISH FOR CONTINUOUS CASTING

BACKGROUND OF THE INVENTION

The present invention relates to a tundish in machines for continuous casting. A tundish is usually used as a buffer for temporarily storing liquid metal to be discharged from a ladle into a tundish and the tundish, in turn, feeds one or several molds. A discharge pipe may be provided for guiding the metal as poured from the ladle into the tundish below the bath level therein. A lifting device may hold this tube against the bottom of the ladle. German printed patent application No. 1,284,577 discloses a tundish of that type.

Generally speaking, it is also known to move a tundish on a carriage into the machine, and it is also know to raise and lower the tundish. It was found to be important that the distance of the outlet of the discharge pipe into the tundish from the bottom thereof remains constant during casting. The known equipment does not necessarily meet this condition.

DESCRIPTION OF THE INVENTION

It is an object of the present invention to improve machines for continuous casting and particularly to ensure that the height relation between the pipe that feeds metal into a tundish, and the bottom of that tundish, remains the same even if the distance between the outlet pipe of the tundish and a mold underneath is charged.

In accordance with the preferred embodiment of the invention, it is suggested to mount the tundish in a machine for continuous casting on a frame that can be lowered and lifted, while the feed pipe for the tundish is likewise mounted for lowering and lifting but this pipe lifting device is either mounted also on the frame to be lowered or lifted therewith, or the lifting device is controlled for synchronous lowering or lifting with the frame so that in either case the distance between the tundish bottom and feed pipe remains constant. Otherwise, the pipe lifting device is used conventionally to hold that pipe against the ladle or remove it thereform.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 shows a foundation 20 with rails 21 on which runs a carriage 1. This carriage supports a tundish 3, as well as a frame 2. Actually, the tundish 3 is mounted on the frame 2. Moreover, the frame has an extension 12 an carries additionally a hydraulic lifting device 4. This lifting device operates an arm 10 which extends laterally from the lifting device and carries a casting or discharge pipe 5, made of refractory material. The lifting device is more or less permanently installed on the frame 2, while pipe 5 and tundish 3 are readily replaceable and exchangeable individually.

Figures 1, 2:
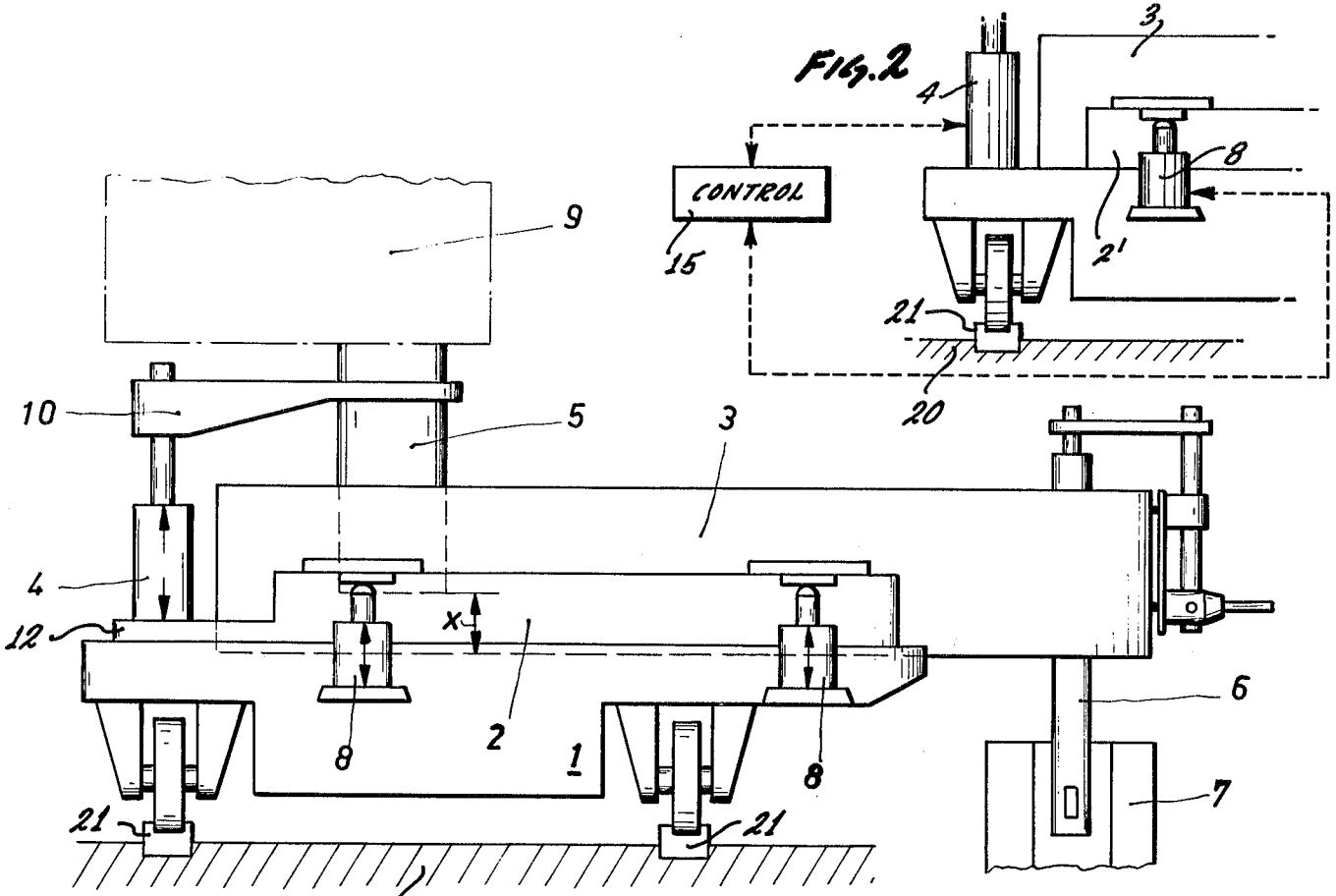
FIG. 1 is a somewhat schematic side view of a tundish improved in accordance with the preferred embodiment of the invention.
FIG. 2 is a somewhat schematic side view of a tundish improved in accordance with an alternative embodiment of the invention.

The frame 2 is mounted and positioned on carriage 1 by means of hydraulic positioners 8, which can lift or lower the frame and all parts mounted thereon. A discharge and feed pipe 6 is provided for feeding metal into a mold 7. Lowering and lifting the tundish lowers and lifts pipe 6 to thereby vary the immersion depth of the outlet of the pipe in mold 7.

Since the lifting device 4 is mounted on the frame 2, it is lifted therewith by operation of the hydraulic cylinder 8. Thus, the distance x between the bottom of the tundish and the outlet of pipe 5 remains invariant for the level adjustment of the tundish relative to the mold 7, whereby particularly that distance is chosen so that the outlet of tube 5 remains below the surface level of the steel in the tundish.

The ladle 9 must be moved out of the way or height adjusted during lowering and lifting of the tundish. During charging of the tundish, lifting device 4 urges the pipe 5 against the bottom of the ladle.

Alternatively, as shown in FIG. 2, the lifting device may be positioned directly on the carriage 1, and not on frame 2. It is necessary in this case to operate the drives 4 and 8 in synchronism and by means of a controller 15, which dynamically keeps the distance x between pipe 5 and tundish 3 constant.

It can readily be seen that the feed pipe 6 can be exchanged, preceded by lifting the tundish while the relative disposition between tundish and pipe 5 remains invariant. Generally speaking, exchange operations of the tundish or just replacement of the feed pipe 6 is facilitated and shortened by the invention. In the illustrated case of FIG. 1, one can lower and raise the pipe 5 relative to the tundish without intervention in any control circuit. The lifting device 4 as per FIG. 1 is simply operated to maintain statically a particular position during manipulation of the tundish.

The invention is not limited to the embodiments described above but all changes and modifications thereof not constituting departures from the spirit and scope of the invention are intended to be included.

I claim:

1. In a machine, for continuous casting which includes a tundish, a discharging pipe for feeding molten metal from a ladle into the tundish, at least one mold for continuous casting and feed pipe on the tundish for feeding metal from the tundish into the mold, and a carriage for the tundish, the improvement comprising:

a lifting frame mounted on the carriage, the tundish being mounted on the frame;

first means on the carriage for lowering and lifting the frame with the tundish;

a lifting device on the carriage holding the discharging and second means operatively connected to the lifting device for obtaining a constant distance of the lower end of the casting pipe from the bottom of the tundish during lowering and lifting of the frame by operation of the first means for lowering and lifting.

2. The improvement as in claim 1, said second means for obtaining being an extended portion of the frame and the lifting device being mounted on said extended portion so that the lifting device itself is lowered and lifted upon lowering and lifting of the frame by operation of said first means for lowering and lifting.

3. The improvement as in claim 1, said second means for obtaining including a controller connected to the first means for lifting and to the lifting device to synchronize their operation.

* * * * *